US008231334B2

(12) United States Patent
Lind et al.

(10) Patent No.: US 8,231,334 B2
(45) Date of Patent: Jul. 31, 2012

(54) SECONDARY INLET CONE FOR A PLENUM FAN

(75) Inventors: Stephen J. Lind, Onalaska, WI (US); Thomas A. Ley, La Crosse, WI (US); Dustin E. J. Meredith, Lexington, KY (US)

(73) Assignee: Trane International Inc., Piscataway, NJ (US)

( * ) Notice: Subject to any disclaimer, the term of this patent is extended or adjusted under 35 U.S.C. 154(b) by 562 days.

(21) Appl. No.: 12/584,862

(22) Filed: Sep. 14, 2009

(65) Prior Publication Data

US 2011/0064571 A1 Mar. 17, 2011

(51) Int. Cl.

| | |
|---|---|
| ***F01D 25/04*** | (2006.01) |
| ***F04D 29/42*** | (2006.01) |
| ***F04D 29/52*** | (2006.01) |
| ***F04D 29/54*** | (2006.01) |

(52) U.S. Cl. ..... 415/119; 415/203; 415/206; 415/208.1

(58) Field of Classification Search ..... 415/119, 415/203, 206, 208.1; 416/178, 187, 189, 416/190, 192, 193 R See application file for complete search history.

(56) References Cited

U.S. PATENT DOCUMENTS

| | | | | |
|---|---|---|---|---|
| 2,287,822 | A * | 6/1942 | Odor et al. | 415/185 |
| 2,798,658 | A | 7/1957 | McDonald | |
| 2,798,659 | A | 7/1957 | Tweedy | |
| 3,070,287 | A | 12/1962 | Eck | |
| 3,278,115 | A | 10/1966 | White et al. | |
| 5,525,036 | A | 6/1996 | Park | |
| 5,551,838 | A | 9/1996 | Hugbart | |
| 5,672,052 | A * | 9/1997 | Ishida et al. | 417/312 |
| 2003/0072648 | A1 * | 4/2003 | Han et al. | 415/119 |
| 2008/0152480 | A1 * | 6/2008 | Ishikawa et al. | 415/119 |

* cited by examiner

*Primary Examiner* — Edward Look
*Assistant Examiner* — William Grigos
(74) *Attorney, Agent, or Firm* — William O'Driscoll

(57) ABSTRACT

A plenum fan comprising a fan wheel disposed within a box-like enclosure includes a secondary inlet cone, a primary inlet cone, and a flexible duct. The two inlet cones convey air to the mouth of the fan wheel. A frame supports the fan wheel and the primary inlet cone such that the frame, the fan wheel and the primary inlet cone comprise a fan assembly. If the fan assembly shifts due to fan thrust or vibration, the fan assembly moves as a unit. The flexible duct connects the primary inlet cone to an inlet of the enclosure while isolating the fan assembly's vibration from the enclosure. The secondary inlet cone extends from the inlet of the enclosure, protrudes into or toward the primary inlet cone and provides a smooth airflow path over the abrupt shape of the flexible duct.

19 Claims, 4 Drawing Sheets

SECONDARY INLET CONE FOR A PLENUM FAN

BACKGROUND OF THE INVENTION

1. Field of the Invention

The subject invention generally pertains to plenum fans and more specifically to an inlet cone arrangement for such a fan.

2. Description of Related Art

A typical plenum fan comprises a fan wheel inside a plenum of a box-like enclosure. Upon drawing air into the enclosure through an inlet, the fan wheel pressurizes the air in the plenum. An outlet in the enclosure releases the pressurized air to perhaps a supply air duct, which can convey the air to a comfort zone or to wherever the air is needed.

To promote smooth inlet airflow, many fans include some type of inlet cone. Examples of various inlet cones are disclosed in U.S. Pat. Nos. 2,798,658; 2,798,659; 3,070,287; 3,278,115; 5,525,036 and 5,551,838. For efficient operation, it usually helps to align such inlet cones accurately to the inlet mouth of the fan wheel. Such alignment can be difficult to maintain if the fan wheel vibrates or otherwise translates relative to the inlet cone. If the radial and axial position of the inlet cone is fixed relative to the fan wheel, then the two might vibrate as a unit. If the vibration transmits to the enclosure of a plenum fan, the enclosure's relatively large side panels might emit appreciable noise. Although plenum fans can be provided with various vibration dampening devices, such devices might adversely affect an inlet cone's alignment to a fan wheel, or they might disrupt an otherwise smooth inlet airflow pattern. Consequently, a need exists for a plenum fan with smooth, quiet and efficient operation.

SUMMARY OF THE INVENTION

It is an object of some embodiments of the invention to provide a plenum fan with two generally concentric, spaced-apart inlet cones, wherein one inlet cone is free to translate and vibrate relative to the other.

Another object of some embodiments is to provide a plenum fan with two generally concentric, spaced-apart inlet cones, wherein one inlet cone is fixed relative to a frame that supports a fan wheel, the other inlet cone is fixed relative to an enclosure containing the fan wheel, and the frame is resiliently coupled to the enclosure to allow limited movement relative thereto.

Another object of some embodiments is to use a second inlet cone to cover a more irregular surface of a flexible duct.

Another object of some embodiments is to isolate the vibration of a fan assembly from an outer enclosure while maintaining a smooth inlet to the fan.

Another object of some embodiments is to provide a plenum fan with relatively tight radial clearance between a fan wheel mouth and an adjacent primary inlet cone and to provide greater radial clearance between the adjacent primary inlet cone and a secondary inlet cone.

One or more of these and/or other objects of the invention are provided by a plenum fan that includes a fan wheel disposed within an enclosure. A flexible duct couples a primary inlet cone to a side panel of the enclosure, wherein the suction duct's flexibility prevents transmission of vibration from the primary inlet cone to the enclosure. A secondary inlet cone attached to the enclosure protrudes into, or at least toward, the primary inlet cone and covers the irregular surface of the flexible duct, thereby providing a smooth inlet flow path to the fan wheel.

The present invention provides a plenum fan for moving air. The plenum fan comprises an enclosure defining an inlet opening, an outlet and a plenum. A frame is disposed within the enclosure. The plenum fan also comprises a fan wheel defining a fan mouth. The fan wheel is supported by the frame within the enclosure. The fan wheel is rotatable to force air sequentially through the inlet opening, through the fan mouth, through the plenum, and out through the outlet. The plenum fan also comprises a secondary inlet cone attached to the enclosure and protruding into the inlet opening, wherein the secondary inlet cone is substantially stationary relative to the enclosure. The plenum fan also comprises a primary inlet cone attached to the frame such that the primary inlet cone is substantially stationary relative to the frame, and air being drawn into the enclosure by the fan wheel passes sequentially through the secondary inlet cone, through the primary inlet cone and through the mouth of the fan wheel. The plenum fan also comprises a flexible duct extending between the primary inlet cone and the enclosure. The flexible duct is more flexible than the secondary inlet cone and the primary inlet cone, wherein the flexibility of the flexible duct permits relative movement between the primary inlet cone and the enclosure and also permits relative movement between the primary inlet cone and the secondary inlet cone.

The present invention also provides a plenum fan for moving air. The plenum fan comprises an enclosure defining an inlet opening, a outlet and a plenum. The plenum fan also comprises a frame disposed within the enclosure. The plenum fan also comprises a fan wheel defining a fan mouth and being supported by the frame within the enclosure. The fan wheel is rotatable to force air sequentially through the inlet opening, through the fan mouth, through the plenum, and out through the outlet. The plenum fan also comprises a secondary inlet cone attached to the enclosure and protruding into the inlet opening, wherein the secondary inlet cone is substantially stationary relative to the enclosure. The plenum fan also comprises a primary inlet cone attached to the frame such that the primary inlet cone is substantially stationary relative to the frame, and air being drawn into the enclosure by the fan wheel passes sequentially through the secondary inlet cone, through the primary inlet cone and through the mouth of the fan wheel. The plenum fan also comprises a flexible duct extending between the primary inlet cone and the enclosure. The flexible duct is more flexible than the secondary inlet cone and the primary inlet cone, wherein the flexibility of the flexible duct permits relative movement between the primary inlet cone and the enclosure and also permits relative axial and radial movement between the primary inlet cone and the secondary inlet cone such that concentricity between the secondary inlet cone and the primary inlet cone varies in response to a change in an air pressure differential between the inlet opening and the outlet.

The present invention further provides a plenum fan for moving air. The plenum fan comprises an enclosure defining an inlet opening, a outlet and a plenum. The plenum fan also comprises a frame disposed within the enclosure. The plenum fan also comprises a fan wheel defining a fan mouth and being supported by the frame within the enclosure. The fan wheel is rotatable to force air sequentially through the inlet opening, through the fan mouth, through the plenum, and out through the outlet. The plenum fan also comprises a motor disposed within the enclosure, coupled to the fan wheel, and supported by the frame. The plenum fan also comprises an secondary inlet cone attached to the enclosure and protruding into the inlet opening, wherein the secondary inlet cone is substantially stationary relative to the enclosure. The plenum fan also comprises a primary inlet cone attached to the frame such that the secondary inlet cone protrudes into the primary inlet cone. The primary inlet cone is substantially stationary relative to the frame, and air being drawn into the enclosure by the fan wheel passes sequentially through the secondary inlet cone, through the primary inlet cone and through the mouth of the fan wheel. The plenum fan also comprises a flexible duct extending between the primary inlet cone and the enclosure, the flexible duct is more flexible than the secondary inlet cone and the primary inlet cone, wherein the flexibility of the flexible duct permits relative movement between the primary inlet cone and the enclosure and also permits relative axial and radial movement between the primary inlet cone and the secondary inlet cone such that concentricity between the secondary inlet cone and the primary inlet cone varies in response to a change in an air pressure differential between the inlet opening and the outlet.

DESCRIPTION OF THE PREFERRED EMBODIMENT

Figure 1:
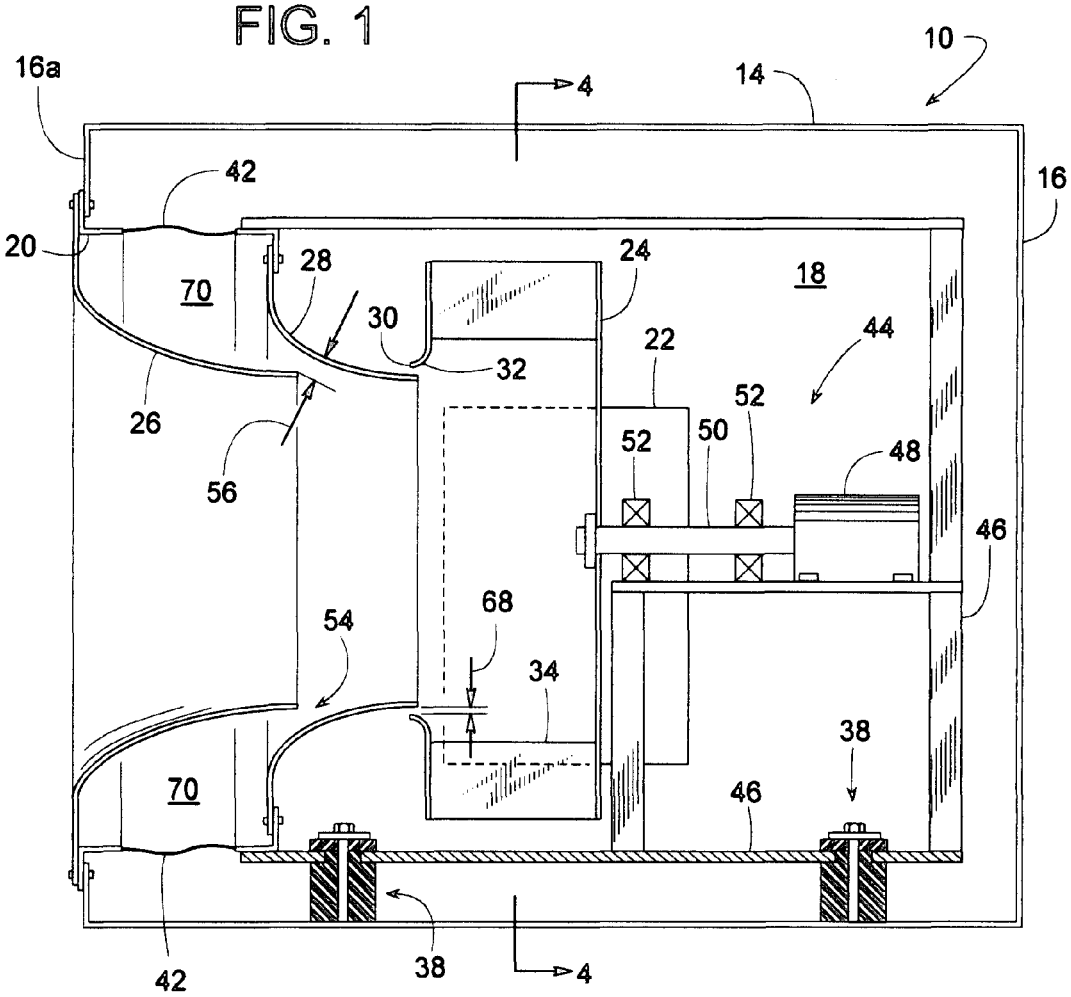
FIG. 1 is a cross-sectional side view of a plenum fan with the fan wheel stationary.
Figure 2:
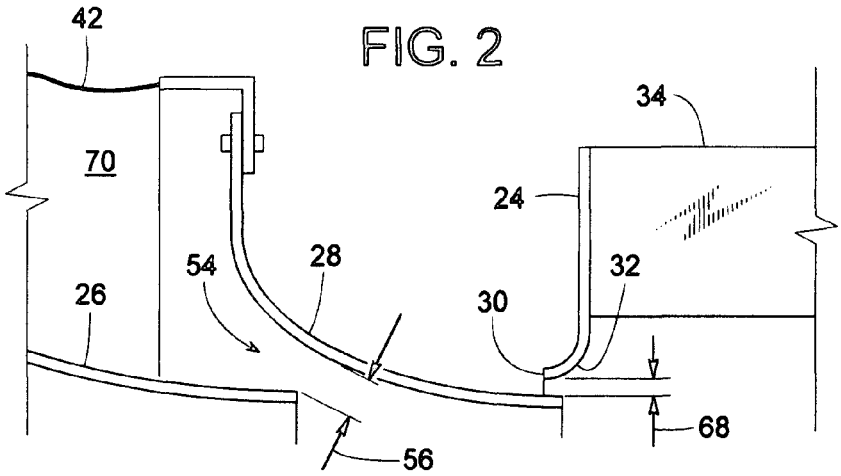
FIG. 2 is an enlarged view of one section of FIG. 1.

FIGS. 1-5 illustrate a plenum fan 10 that forces air 12 through a box-like enclosure 14 comprising a plurality of sheet metal side panels 16 that define a plenum 18 in fluid communication with an inlet opening 20 and an outlet 22. A fan wheel 24 (e.g., a centrifugal fan wheel, vane axial fan wheel, etc.) rotating within plenum 18 draws air 12 into enclosure 14 through inlet opening 20. Air 12 flows sequentially through a secondary inlet cone 26, a primary inlet cone 28, and a fan mouth 30 of fan wheel 24. Inlet cones 26 and 28 are smoothly curved funnels that minimize airflow pressure losses. Inlet cones 26 and 28 can be formed of sheet metal or some other relatively rigid material. To further minimize losses, fan wheel 24 preferably has a curved rim 32 at fan mouth 30. Upon entering fan wheel 24, a plurality of fan blades 34 then forces air 12 through plenum 18 and out through outlet 22. An air duct 36 at outlet 22 can be used for conveying air 12 to a comfort zone or to wherever air 12 might be needed.

To minimize noise emitted from enclosure 14, a plurality of vibration isolators 38 and a flexible duct 42 inhibit the transmission of vibration from a fan assembly 44 to enclosure 14. Although the actual construction of plenum fan 10 may vary, the illustrated example of fan assembly 44 comprises a frame 46, a motor 48 attached to frame 46, fan wheel 24 attached to a rotor shaft 50 of motor 48, one or more bearings 52 for supporting shaft 50, and primary inlet cone 28 attached to frame 46. Since fan wheel 24, motor 48 and primary inlet cone 28 share a common support frame (frame 46), fan assembly 44 can move as unit, by vibration or by a pressure differential developed by fan wheel 24.

To accommodate such movement, flexible duct 42 extends between primary inlet cone 28 to a side panel 16*a* of enclosure 14. Flexible duct 42 is made preferably of a sealed fabric or otherwise flexible or pliable sheet material that allows primary inlet cone 28 to move freely both radially and axially relative to panel 16*a*.

To prevent flexible duct 42 from creating a disruptive flow path for air 12 flowing between inlet opening 20 and primary inlet cone 28, secondary inlet cone 26 extends from side panel 16*a*, overlaps flexible duct 42, and protrudes into or toward primary inlet cone 28. An annular gap 54 provides radial and axial clearance 56 between inlet cones 26 and 28 so that primary inlet cone 28 can move and vibrate without engaging secondary inlet cone 26. The area or geometry of annular gap 54 varies in response to relative movement between frame 46 and enclosure 16. If, for instance, primary inlet cone 28 moves axially toward secondary inlet cone 26, the geometry of annular gap 54 becomes smaller in its overall area. If primary inlet cone 28 moves in a radial direction relative to secondary inlet cone 26, thus changing the concentricity of inlet cones 26 and 28, the radial clearance 56 provided by gap 54 is reduced on the side in which primary inlet cone 28 moves.

Since primary inlet cone 28 and fan wheel 24 are both supported by frame 46 there is relatively little radial movement between primary inlet cone 28 and fan wheel 24. This allows a radial clearance 68 between primary inlet cone 28 and the fan wheel's rim 32 to be relatively small, and preferably smaller than the radial clearance 56 between inlet cones 26 and 28 when fan wheel 24 is at rest.

Figure 3:
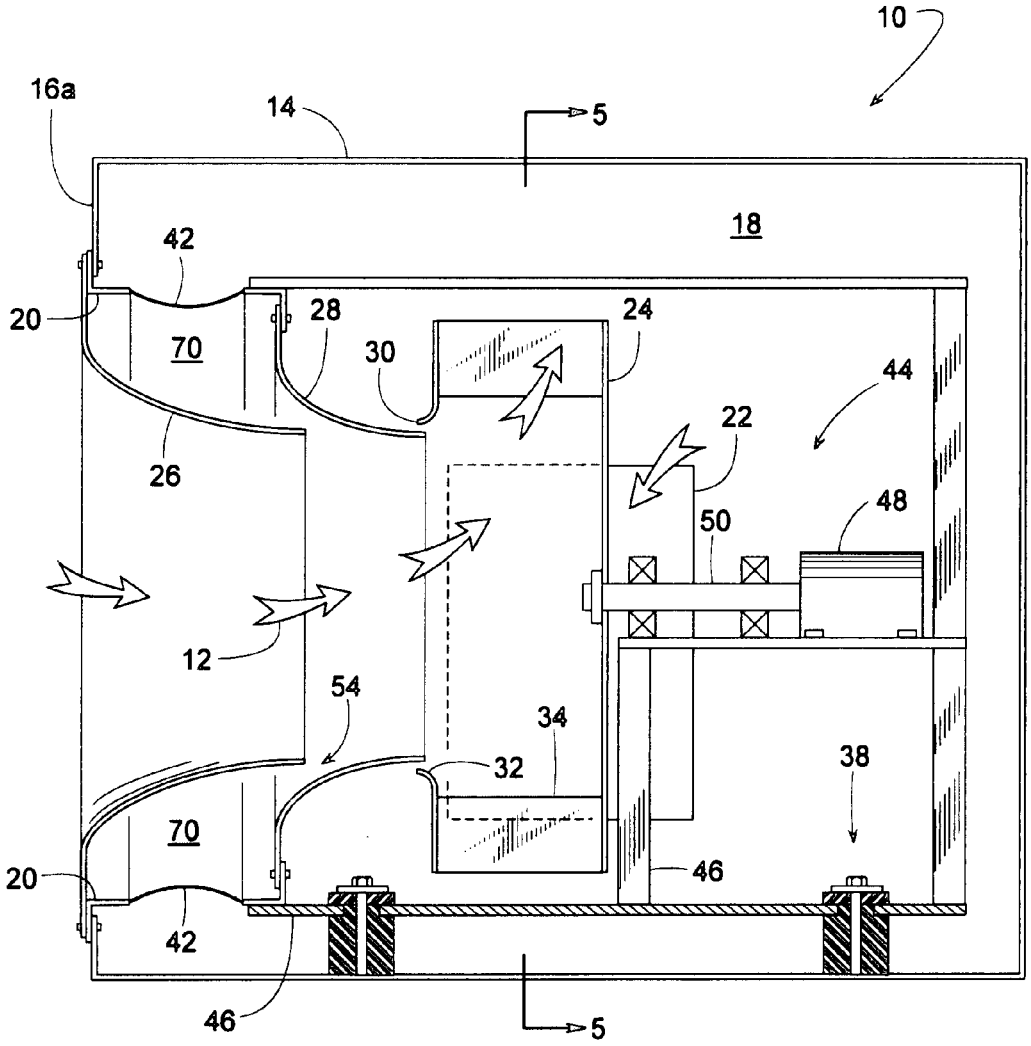
FIG. 3 is a cross-sectional view similar to FIG. 1 but showing the motor energized and rotating the fan wheel.
Figure 4:
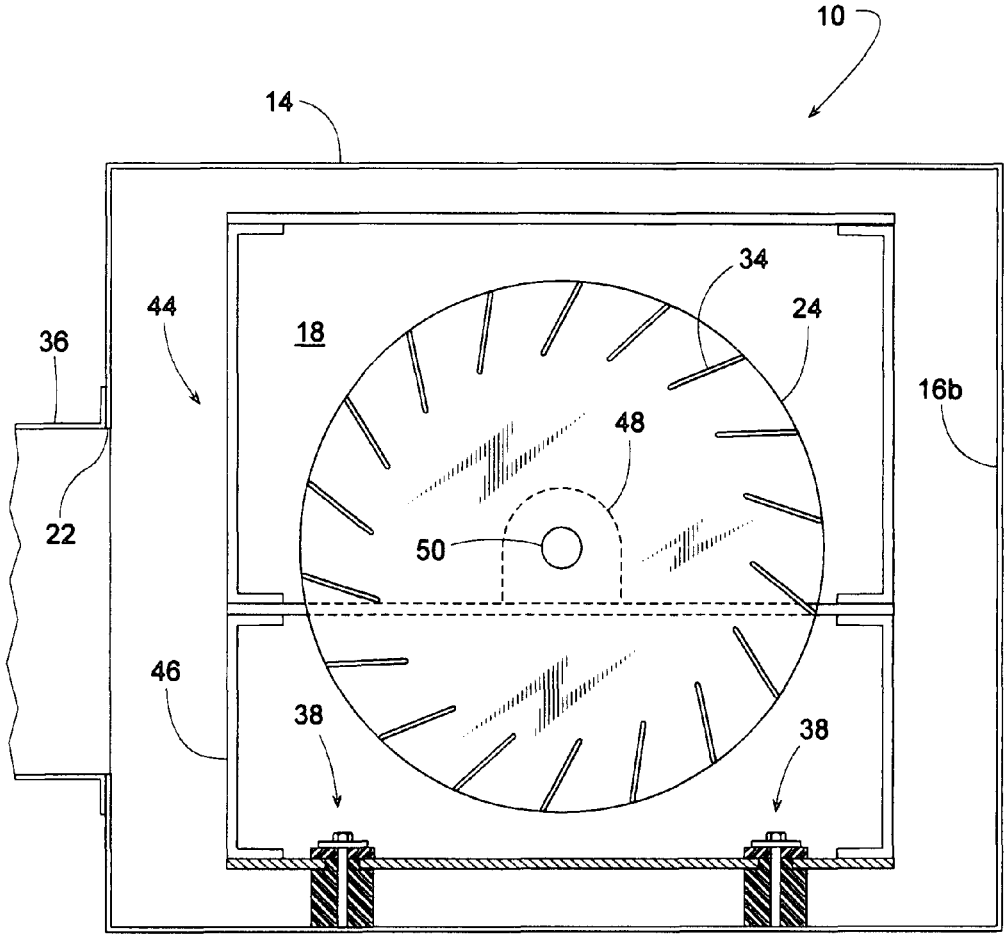
FIG. 4 is a cross-sectional view taken along line 4-4 of FIG. 1.
Figure 5:
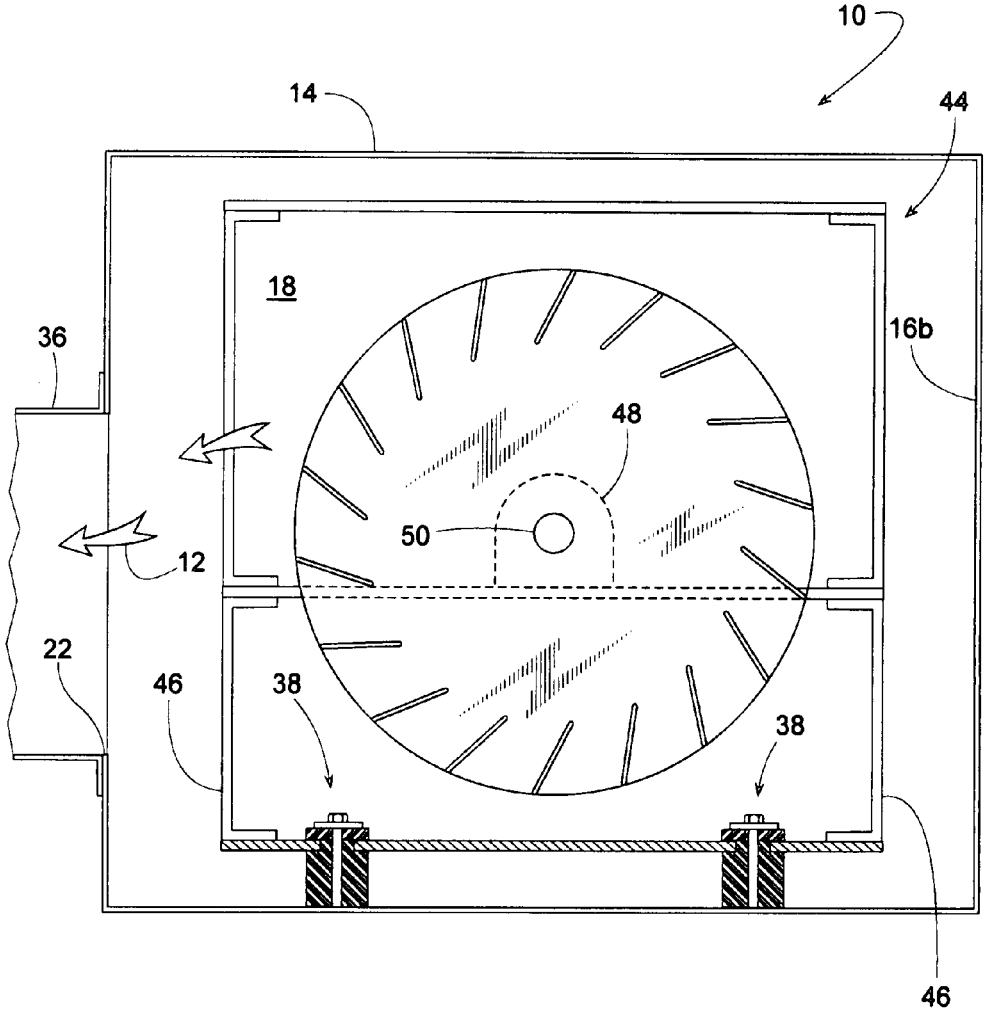
FIG. 5 is a cross-sectional view taken along line 5-5 of FIG. 3.

An annular chamber 70 exists within the confines of secondary inlet cone 26, primary inlet cone 28 and flexible duct 42. Air 12 within chamber 70 is relatively stagnant, since air 12 preferably only enters or leaves chamber 70 through annular gap 54. The relatively stagnant air in chamber 70 helps ensure that air 12 flows smoothly from secondary inlet cone 16 to primary inlet cone 28. Flexible duct 42 can be rather limp and pliable when fan 10 is turned off, as shown in FIG. 1. When fan 10 turns on, however, flexible duct 42 becomes rather taut, or at least more taut, due to the air pressure differential across the inner and outer surfaces of duct 42. This pressure differential forces the flexible duct 42 radially inward, as shown in FIG. 3, thereby creating a reduced and generally fixed volume of air within annular chamber 70. The generally fixed, reduced volume of air in chamber 70 preferably promotes the stagnation of air in chamber 70 and thus preferably minimizes that air's disruption of the other air that is flowing across gap 54 from secondary inlet cone 26 to primary inlet cone 28. Lining some of the surfaces of chamber 70 with some type of sound absorbing material might also reduce noise.

Although the invention is described with respect to a preferred embodiment, modifications thereto will be apparent to those of ordinary skill in the art. The fan, for instance, could be belt-driven as opposed to being direct-drive. Also, the illustrated vibration isolator is for sake of example, and it should be appreciated by those of ordinary skill in the art that the use of other types of vibration isolators, snubbers, and/or thrust restraints are certainly possible, or such devices could be eliminated altogether. The scope of the invention, therefore, is to be determined by reference to the following claims:

The invention claimed is:

1. A plenum fan for moving air, the plenum fan comprising:

an enclosure defining an inlet opening, an outlet and a plenum;

a frame disposed within the enclosure;

a fan wheel defining a fan mouth and being supported by the frame within the enclosure, the fan wheel is rotatable to force air sequentially through the inlet opening, through the fan mouth, through the plenum, and out through the outlet;

a secondary inlet cone attached to the enclosure and protruding into the inlet opening, wherein the secondary inlet cone is substantially stationary relative to the enclosure;

a primary inlet cone attached to the frame such that the primary inlet cone is substantially stationary relative to the frame, and air being drawn into the enclosure by the fan wheel passes sequentially through the secondary inlet cone, through the primary inlet cone and through the mouth of the fan wheel; and a flexible duct extending between the primary inlet cone and the enclosure, the flexible duct is more flexible than the secondary inlet cone and the primary inlet cone, wherein the flexibility of the flexible duct permits relative movement between the primary inlet cone and the enclosure and also permits relative movement between the primary inlet cone and the secondary inlet cone.

2. The plenum fan of claim 1, wherein the secondary inlet cone protrudes into the primary inlet cone.

3. The plenum fan of claim 1, wherein the flexible duct accommodates relative axial movement between the secondary inlet cone and the primary inlet cone.

4. The plenum fan of claim 1, wherein the flexible duct accommodates relative radial movement between the secondary inlet cone and the primary inlet cone.

5. The plenum fan of claim 1, wherein the secondary inlet cone and the primary inlet cone define an annular gap therebetween.

6. The plenum fan of claim 5, wherein the annular gap has a geometry that varies in response to relative movement between the frame and the enclosure.

7. The plenum fan of claim 1, wherein concentricity between the secondary inlet cone and the primary inlet cone varies in response to vibration of the fan wheel.

8. The plenum fan of claim 1, wherein the fan wheel includes a curved rim that defines the fan mouth, and the curved rim is rotatable relative to both the secondary inlet cone and the primary inlet cone.

9. The plenum fan of claim 8, wherein the secondary inlet cone and the primary inlet cone define a first radial clearance therebetween, the curved rim and the primary inlet cone define a second radial clearance therebetween, the first radial clearance is larger than the second radial clearance when the fan wheel is substantially still.

10. The plenum fan of claim 1, further comprising a motor disposed within the enclosure, coupled to the fan wheel, and supported by the frame.

11. The plenum fan of claim 10, further comprising an annular chamber defined by the secondary inlet cone, the primary inlet cone and the flexible duct, wherein the annular chamber has a volume that is larger when the motor is de-energized than when the motor is energized and rotating the fan wheel.

12. The plenum fan of claim 1, wherein the fan wheel is a centrifugal fan wheel.

13. A plenum fan for moving air, the plenum fan comprising:

an enclosure defining an inlet opening, an outlet and a plenum;

a frame disposed within the enclosure;

a fan wheel defining a fan mouth and being supported by the frame within the enclosure, the fan wheel is rotatable to force air sequentially through the inlet opening, through the fan mouth, through the plenum, and out through the outlet;

a secondary inlet cone attached to the enclosure and protruding into the inlet opening, wherein the secondary inlet cone is substantially stationary relative to the enclosure;

a primary inlet cone attached to the frame such that the primary inlet cone is substantially stationary relative to the frame, and air being drawn into the enclosure by the fan wheel passes sequentially through the secondary inlet cone, through the primary inlet cone and through the mouth of the fan wheel; and a flexible duct extending between the primary inlet cone and the enclosure, the flexible duct is more flexible than the secondary inlet cone and the primary inlet cone, wherein the flexibility of the flexible duct permits relative movement between the primary inlet cone and the enclosure and also permits relative axial and radial movement between the primary inlet cone and the secondary inlet cone such that concentricity between the secondary inlet cone and the primary inlet cone varies in response to vibration of the fan wheel.

14. The plenum fan of claim 13, wherein the secondary inlet cone protrudes into the primary inlet cone.

15. The plenum fan of claim 13, wherein the secondary inlet cone and the primary inlet cone define an annular gap therebetween, wherein the annular gap has a geometry that varies in response to relative movement between the frame and the enclosure.

16. The plenum fan of claim 13, wherein the fan wheel includes curved rim that defines the fan mouth, and the curved rim is rotatable relative to both the secondary inlet cone and the primary inlet cone.

17. The plenum fan of claim 16, wherein the secondary inlet cone and the primary inlet cone define a first radial clearance therebetween, the curved rim and the primary inlet cone define a second radial clearance therebetween, the first radial clearance is larger than the second radial clearance when the fan wheel is substantially still.

18. The plenum fan of claim 17, further comprising an annular chamber defined by the secondary inlet cone, the primary inlet cone and the flexible duct, wherein the annular chamber has a volume that is larger when the motor is de-energized than when the motor is energized and rotating the fan wheel.

19. A plenum fan for moving air, the plenum fan comprising:

an enclosure defining an inlet opening, an outlet and a plenum;

a frame disposed within the enclosure;

a fan wheel defining a fan mouth and being supported by the frame within the enclosure, the fan wheel is rotatable to force air sequentially through the inlet opening, through the fan mouth, through the plenum, and out through the outlet;

a motor disposed within the enclosure, coupled to the fan wheel, and supported by the frame;

an secondary inlet cone attached to the enclosure and protruding into the inlet opening, wherein the secondary inlet cone is substantially stationary relative to the enclosure;

a primary inlet cone attached to the frame such that the secondary inlet cone protrudes into the primary inlet cone, the primary inlet cone is substantially stationary relative to the frame, and air being drawn into the enclosure by the fan wheel passes sequentially through the secondary inlet cone, through the primary inlet cone and through the mouth of the fan wheel; and a flexible duct extending between the primary inlet cone and the enclosure, the flexible duct is more flexible than the secondary inlet cone and the primary inlet cone, wherein the flexibility of the flexible duct permits relative movement between the primary inlet cone and the enclosure and also permits relative axial and radial movement between the primary inlet cone and the secondary inlet cone such that concentricity between the secondary inlet cone and the primary inlet cone varies in response to vibration of the fan wheel.

* * * * *